US008227168B2

(12) United States Patent
Moffat et al.

(10) Patent No.: US 8,227,168 B2
(45) Date of Patent: Jul. 24, 2012

(54) POLYESTER SYNTHESIS

(75) Inventors: Karen Ann Moffat, Brantford (CA); Jordan H. Wosnick, Toronto (CA)

(73) Assignee: Xerox Corporation, Norwalk, CT (US)

( * ) Notice: Subject to any disclaimer, the term of this patent is extended or adjusted under 35 U.S.C. 154(b) by 543 days.

(21) Appl. No.: 12/502,488

(22) Filed: Jul. 14, 2009

(65) Prior Publication Data

US 2011/0014564 A1 Jan. 20, 2011

(51) Int. Cl.
*G03G 9/087* (2006.01)

(52) U.S. Cl. ..... 430/137.15; 430/137.1

(58) Field of Classification Search ..... 430/137.1, 430/137.15

See application file for complete search history.

(56) References Cited

U.S. PATENT DOCUMENTS

| | | | | |
|---|---|---|---|---|
| 3,590,000 | A | 6/1971 | Palermiti et al. | |
| 3,800,588 | A | 4/1974 | Larson et al. | |
| 3,847,604 | A | 11/1974 | Hagenbach et al. | |
| 4,295,990 | A | 10/1981 | Verbeek et al. | |
| 4,298,672 | A | 11/1981 | Lu | |
| 4,338,390 | A | 7/1982 | Lu | |
| 4,795,689 | A | 1/1989 | Akitoshi et al. | |
| 4,935,326 | A | 6/1990 | Creatura et al. | |
| 4,937,166 | A | 6/1990 | Creatura et al. | |
| 4,940,644 | A | 7/1990 | Akitoshi et al. | |
| 5,049,603 | A * | 9/1991 | Mochizuki | 524/97 |
| 5,236,629 | A | 8/1993 | Mahabadi et al. | |
| 5,290,654 | A | 3/1994 | Sacripante et al. | |
| 5,302,486 | A | 4/1994 | Patel et al. | |
| 5,330,874 | A | 7/1994 | Mahabadi et al. | |
| 6,063,827 | A | 5/2000 | Sacripante et al. | |
| 6,120,967 | A | 9/2000 | Hopper et al. | |
| 6,214,507 | B1 | 4/2001 | Sokol et al. | |
| 6,593,049 | B1 | 7/2003 | Veregin et al. | |
| 6,756,176 | B2 | 6/2004 | Stegmamat et al. | |
| 6,830,860 | B2 | 12/2004 | Sacripante et al. | |
| 7,083,889 | B2 * | 8/2006 | Yamazaki et al. | 430/109.4 |
| 7,118,843 | B2 * | 10/2006 | Teshima | 430/137.14 |
| 7,645,553 | B2 * | 1/2010 | Matsumura et al. | 430/124.1 |
| 2006/0222991 | A1 | 10/2006 | Sacripante et al. | |
| 2009/0162762 | A1 | 6/2009 | Maehata et al. | |

FOREIGN PATENT DOCUMENTS

| | | |
|---|---|---|
| EP | 2 159 643 A1 | 3/2010 |

OTHER PUBLICATIONS

European Search Report dated Oct. 6, 2010 for copending European application No. 10169460.

Laurent Néry, et al., "Polyamide-Polyester Multiblock Copolymers by Chain-Coupling Reactions of Carboxy-Terminated Polymers with Phenylene and Pyridylene Bisoxazolines", *Journal of Polymer Science: Part A: Polymer Chemistry*, vol. 43, pp. 1331-1341 (2005).

* cited by examiner

*Primary Examiner* — Hoa V Le
(74) *Attorney, Agent, or Firm* — Judith L. Byorick

(57) ABSTRACT

The present disclosure provides processes for the production of block copolymer polyester resins suitable for use in manufacturing toners. In embodiments, the copolymers include both a crystalline block and an amorphous block, which can self-assemble to form nanoparticles suitable for use in forming toners.

20 Claims, No Drawings

POLYESTER SYNTHESIS

BACKGROUND

The present disclosure is generally directed to polyester synthesis processes and, more specifically, to processes for the synthesis of polyester resins which may be utilized in the formation of emulsion aggregation toners.

Electrophotographic printing utilizes toner particles which may be produced by a variety of processes. One such process includes an emulsion aggregation ("EA") process that forms toner particles in which surfactants are used in forming a latex emulsion. See, for example, U.S. Pat. No. 6,120,967, the disclosure of which is hereby incorporated by reference in its entirety, as one example of such a process.

Combinations of amorphous and crystalline polyesters may be used in the EA process. This resin combination provides toners with high gloss and relatively low-melting point characteristics (sometimes referred to as low-melt, ultra low melt, or ULM), which allows for more energy efficient and faster printing. The choice of crystalline polymer may be important as poor crystalline-amorphous polymer combinations may result in toners that either do not show low-melt behavior or exhibit unacceptable heat cohesion properties.

Control of the distribution of the crystalline component within a polyester EA toner particle may be important in realizing optimal toner performance, especially in the area of charging, where crystalline polyesters on the particle surface can lead to poor charge (this may be caused, in some cases, due to the conductivity of the crystalline polyester resin). For example, EA ULM toners have been developed which use an amorphous polyester shell to limit the migration of crystalline polyester to the toner particle surface. The crystalline component may be sequestered in the interior of core-shell nanoparticles, surrounded by an amorphous resin shell. Molecule-level confinement may thus prevent the crystalline material from migrating to the toner particle surface, thereby providing desirable charging characteristics.

There is a continual need for improving polyester resins synthesis, as well as the use of polyesters in the formation of EA ULM toners.

SUMMARY

The present disclosure provides processes for producing polyester resins, as well as toners utilizing such resins. In embodiments, a process of the present disclosure may include contacting a first polyester with a coupling agent, optionally in solution; contacting the first polyester with a second polyester, optionally in solution; allowing the first polyester and second polyester to react, thereby forming a block copolyester resin; recovering the copolyester resin comprising a crystalline block and an amorphous block; contacting the copolyester resin with at least one colorant, an optional wax, and an optional surfactant to form toner particles; and recovering the toner particles, wherein either the first polyester or the second polyester comprises the crystalline block, and the other polyester comprises the amorphous block.

In embodiments, a process of the present disclosure may include contacting a first polyester with an anhydride, optionally in solution to form a carboxylic functional group on at least one end of the first polyester; contacting the first polyester with a second polyester possessing a hydroxyl group on at least one end of the second polyester, optionally in solution; allowing the first polyester and second polyester to react, thereby forming a block copolyester resin; recovering the copolyester resin comprising a crystalline block and an amorphous block; contacting the copolyester resin with at least one colorant, an optional wax, and an optional surfactant to form toner particles; and recovering the toner particles, wherein either the first polyester or the second polyester comprises the crystalline block, and the other polyester comprises the amorphous block.

In yet other embodiments, a process of the present disclosure may include providing a first polyester possessing carboxylic acid functional groups on at least one end of the first polyester, and a second polyester possessing carboxylic acid functional groups on at least one end of the second polyester; contacting the first polyester, optionally in solution, with the second polyester, optionally in solution, and a coupling agent comprising a bisoxazoline; allowing the first polyester and second polyester to react, thereby forming a block copolyester resin; recovering the copolyester resin comprising a crystalline block and an amorphous block; contacting the copolyester resin with at least one colorant, an optional wax, and an optional surfactant to form toner particles; and recovering the toner particles, wherein either the first polyester or the second polyester comprises the crystalline block, and the other polyester comprises the amorphous block.

DETAILED DESCRIPTION

The present disclosure relates to polymerization processes for the production of resins suitable for use in the formation of toners. In embodiments, processes of the present disclosure may be utilized to produce block copolymers including distinct crystalline polyester blocks and distinct amorphous polyester blocks. These copolymers may self-assemble in water or a similar media to form nanoparticles suitable for forming toner compositions. In embodiments, the nanoparticles may possess a core-shell configuration, with the crystalline block forming the core and the amorphous block forming the shell.

In embodiments, core-shell polyester nanoparticles may be formed from copolymers formed by the reactive coupling of a crystalline polyester segment to an amorphous polyester segment. By suitable choice of block components and block sizes, polyesters containing one or more amorphous blocks linked to one or more crystalline blocks may be prepared.

Resins

Any monomer or starting material suitable for preparing a resin for use in a toner may be utilized. In embodiments of the present disclosure, the resin may be a block copolymer including at least one amorphous polyester block and at least one separate crystalline polyester block. The starting materials may be selected so that at least one of the starting monomers forms a crystalline block, with at least one other monomer forming an amorphous block.

The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid or diester in the presence of an optional catalyst. For forming a crystalline polyester, suitable organic diols include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof. The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly (propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfoisophthalate), copoly(propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

In embodiments, an unsaturated, amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly (butyloxylated bisphenol co-fumarate), poly(co-propoxylated bisphenol co-ethoxylated bisphenol co-fumarate), poly (1,2-propylene fumarate), poly(propoxylated bisphenol co-maleate), poly(ethoxylated bisphenol co-maleate), poly (butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof. In embodiments, the amorphous resin may be linear.

In embodiments, a suitable amorphous polyester resin may be a poly(propoxylated bisphenol A co-fumarate) resin having the following formula (I):

(I)

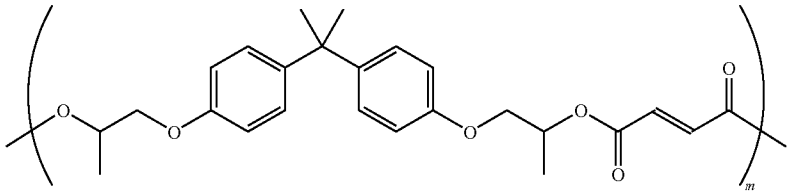

wherein m may be from about 5 to about 1000. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

Suitable crystalline resins include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

(II)

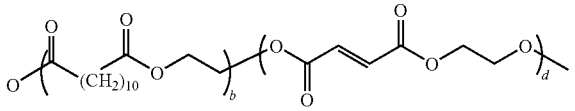

wherein b is from about 5 to about 2000 and d is from about 5 to about 2000.

In embodiments, a suitable crystalline resin utilized in a toner of the present disclosure may have a molecular weight of from about 10,000 to about 100,000, in embodiments from about 15,000 to about 30,000.

Two or more resins may be used in forming a copolymer suitable for use in forming a toner. Where two or more resins are used, the resins may be in any suitable ratio (e.g., weight ratio) such as, for instance, from about 1% (first resin)/99% (second resin) to about 99% (first resin)/1% (second resin), in embodiments from about 10% (first resin)/90% (second resin) to about 90% (first resin)/10% (second resin).

In embodiments, the resins may be formed by emulsion polymerization methods.

Copolymer Formation

Once obtained, the crystalline and amorphous polyesters described above may be combined to form copolymers including distinct crystalline polyester blocks and amorphous polyester blocks. There are a variety of chemical reactions that can be performed to couple the crystalline polyester resin to the amorphous polyester resin. In embodiments, the reaction may occur by contacting at least the crystalline polyester block, the amorphous polyester block, or both, with a coupling agent. As used herein, for example, a coupling agent may include, in embodiments, any component that may modify a polyester thereby permitting its reaction with the other polyester, thereby forming a copolyester resin of the present disclosure.

For example, in embodiments, if the crystalline polyester (CPE) resin is terminated with a hydroxyl group (X═OH on both chain ends), then the addition of a coupling agent such as an anhydride, including, for example, trimellitic anhydride, phthalic anhydride, glutaric anhydride, succinic anhydride or maleic anhydride, in a 1:1 molar ratio, can convert one hydroxyl chain end into a carboxylic acid functionality. This carboxylic acid functionalized crystalline polyester resin may then be reacted with an amorphous polyester (APE) resin terminated with hydroxyl groups as illustrated in Scheme III below (using succinic anhydride as the anhydride).

(III)

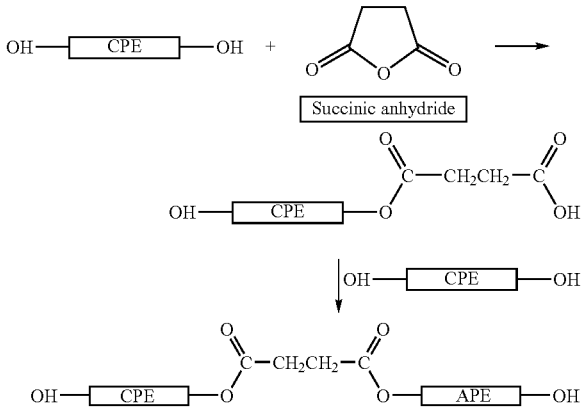

In other embodiments, the anhydride may be reacted with an amorphous polyester resin terminated with hydroxyl groups to form a carboxylic acid functionalized amorphous polyester resin, which may then be reacted with a crystalline polyester resin terminated with hydroxyl groups.

Following the above reaction scheme, a block copolymer may thus be produced. As depicted in the above scheme, in embodiments, a di-block copolymer may be produced. In other embodiments, the free hydroxyl groups present on the opposite end of the crystalline polyester may then be reacted with the same or different amorphous polyester to form a tri-block copolymer.

In other embodiments, the crystalline polyester and/or amorphous polyester blocks depicted in scheme III may be further reacted with an anhydride, producing an additional carboxylic acid group which may, in turn, be reacted with additional hydroxyl-functional crystalline polyesters or amorphous polyesters, thereby creating larger multi-block copolymer resins.

In other embodiments, a suitable reactive coupling agent that can be used to couple the crystalline polymer chain with the amorphous polymer chain includes bisoxazolines. This approach generates polyamide-polyester multi-block copolymers by reacting the bisoxazoline with a carboxylic functional group at the end of the crystalline polymer, the amorphous polymer, or both. The carboxylic functional group may be introduced at the end of the crystalline polymer and/or the amorphous polymer by reaction with an anhydride as described above, the carboxylic functional group may be introduced at the end of the crystalline and/or amorphous polymer by using a molar excess of the dicarboxylic acid reagent during the polycondensation reaction to produce the resulting polyester resins or, combinations thereof, and the like.

Suitable bisoxazolines which may be used in this reaction include 2,2'-(1,3-phenylene)bis(2-oxazoline) (mbox), 2,2'-(1,4-phenylene)bis(2-oxazoline) (pbox), 2,2'-(2,6-pyridylene)bis(2-oxazoline) (pybox), or other aryl or alkyl chain substituted bisoxazolines. For example, the R group in Scheme IV depicted below can be aromatic and substituted in the 2, 4, or 5 position of the aromatic ring, or in the case of derivatives of mbox, the aromatic ring could be substituted at the 2 or 3 or 5 or 6 position, or in the case of derivatives of pbox, the aromatic ring could be substituted at the 3, 4 or 5 position of the pyridine ring. R can also be an alkyl chain —$(CH_2)$n-of varying chain length where n can be from about 2 to about 10, combinations thereof, and the like. Bisoxazolines may be used to couple crystalline polyester polymers terminated at each end with carboxylic acids with amorphous polyester polymers terminated at each end with carboxylic acids, thereby producing di-block or tri-block copolymers, depending on the ratio of polymers. The reaction scheme is illustrated in Scheme IV below.

tionality of the polyester chain end may then occur between the amorphous and crystalline resins, and a polyester copolymer formed which may then be used in the production of a toner. The precise order of the addition of reactants may depend, in embodiments, on the reaction mechanism for coupling the crystalline and amorphous polyesters. Thus, for example, where an anhydride is utilized to introduce a carboxylic acid group on the end of a crystalline or amorphous polyester resin, the first resin and anhydride might be combined to form the carboxylic acid group on the end of the first resin, followed by the addition of the second resin.

The reaction may take place without solvents at an elevated temperature of about 200° C. when the bulk polyester resin is molten and liquid like. Optionally, the crystalline block(s) and coupling agent(s) may be in solution, the amorphous block(s) and coupling agent(s) may be in solution, or both resins and coupling agent(s) may be in the same or separate solutions.

Where utilized, suitable solvents include toluene, dichloromethane, xylene and other organic solvents.

The resulting copolyester resin, which includes a crystalline block and an amorphous block, may then be recovered.

Where the polyester resins are in solution, the polyester resins may be at a concentration of from about 10% by weight to about 90% by weight, in embodiments from about 30% by weight to about 60% by weight.

The time for the reaction may depend upon the type and amount of polyester resins utilized, the length of the polymer chains, i.e., molecular weights, the amount of coupling agent(s) utilized, the temperature of the reaction, and the like. In (IV)

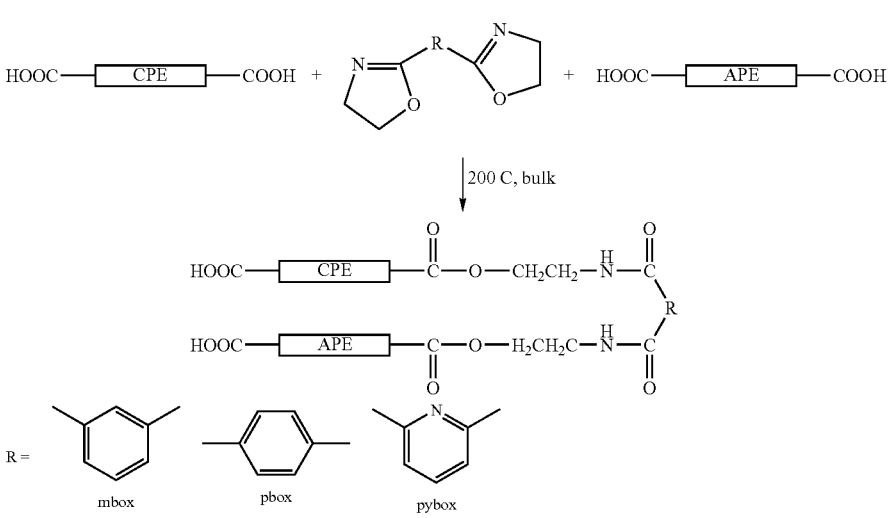

In embodiments, conditions for conducting this reaction are similar to those disclosed by Nery et al, "Polyamide-Polyester Multiblock Copolymers by Chain-Coupling Reactions of Carboxy-Terminated Polymers with Phenylene and Pyridylene Bisoxazolines," Journal of Polymer Science: Part A: Polymer Chemistry, Vol. 43, 1331-1341, (2005), the disclosure of which is hereby incorporated by reference in its entirety.

In the coupling reaction, the crystalline and amorphous polymers may be added to a suitable reactor, such as a mixing vessel equipped with a nitrogen inlet and outlet and a central mechanical stirrer. The appropriate amount of starting polymers and the coupling agent, such as an anhydride or bisoxazoline as described above may be added thereto. The reactor may be placed in an oil bath at a temperature of about 200° C. and a bulk reaction of the bisoxazoline with the acid funcembodiments, the reaction mixture may be mixed for from about 1 minute to about 72 hours, in embodiments from about 4 hours to about 24 hours, while keeping the temperature within the operational range of the coupling agent(s) being used, in embodiments from about 90° C. to about 180° C., in embodiments from about 95° C. to about 170° C., in other embodiments from about 100° C. to about 160° C. As noted above, where the reaction is in bulk, and no solvent is used, the reaction temperature may be about 200° C. to melt the resin.

Those skilled in the art will recognize that optimization of crystalline and amorphous polyesters utilized to form the blocks, reaction conditions, temperature, and coupling agent (s) can be varied to generate polyesters of various molecular weights, and that structurally related starting materials may be polymerized using comparable techniques.

The resins thus produced may include crystalline blocks having a melting temperature (Tm) of from about 40° C. to about 120° C., in embodiments from about 50° C. to about 100° C., in embodiments from about 60° C. to about 80° C. The resins thus produced may also include amorphous blocks having a glass transition temperature (Tg) of from about 40° C. to about 70° C., in embodiments from about 50° C. to about 65° C.

The copolymers may have a number average molecular weight ($M_n$), as measured by gel permeation chromatography (GPC) of, for example, from about 2,000 to about 200,000, in embodiments from about 10,000 to about 100,000, and a weight average molecular weight ($M_w$) of, for example, from about 2,000 to about 200,000, in embodiments from about 10,000 to about 100,000, as determined by Gel Permeation Chromatography using polystyrene standards. The molecular weight distribution ($M_w/M_n$) of the copolymer may be, for example, from about 1.01 to about 4.0, in embodiments from about 1.1 to about 2.0.

The resulting copolymer may possess crystalline blocks in amounts of from about 1 to about 90 percent by weight of the block copolymer, in embodiments from about 5 to about 60 percent by weight of the block copolymer, and amorphous blocks in amounts of from about 10 to about 99 percent by weight of the block copolymer, in embodiments from about 40 to about 95 percent by weight of the block copolymer.

The weight of the resulting polymers may depend on the polyester resins, reaction conditions, and the coupling agent (s) being used.

In embodiments, the final copolymer polyester may be utilized to form toner particles where the copolymer polyester resins is made into an aqueous resin emulsion by either self-dispersing, solvent flash emulsification, solvent free emulsification, phase inversion emulsification, or other means to disperse the polyester resin into water to form a stable resin emulsion. The resin latex particle size may be from about 20 nm to about 400 nm, in embodiments from about 50 nm to about 250 nm. In embodiments, if the particle size of the polyester copolymer is too large, the particles may be subjected to homogenizing or sonication to further disperse the nanoparticles and break apart any agglomerates or loosely bound particles. Where utilized, a homogenizer, (that is, a high shear device), may operate at a rate of from about 6,000 rpm to about 10,000 rpm, in embodiments from about 7,000 rpm to about 9,750 rpm, for a period of time of from about 0.5 minutes to about 60 minutes, in embodiments from about 5 minute to about 30 minutes, although speeds and times outside these ranges may be utilized.

In embodiments, a suitable choice of polyester resin combinations and block lengths produces polymers that spontaneously self-assemble into core-shell nanoparticles when placed in water or a similar media such as mixtures of water and alcohol, water and tetrahydrofuran, and the like. For example, co-polymer including a crystalline polyester and an amorphous polyester may be formed that, when dispersed in water, may organize into core-shell nanoparticles with an inner core of the crystalline polyester and a water-stabilizing amorphous polyester shell. This particle can then be incorporated into toner with other standard toner ingredients using an emulsion aggregation process.

The crystalline block of the copolymer resin may be present, for example, in an amount of from about 1 to about 90 percent by weight of the toner components, in embodiments from about 50 to about 60 percent by weight of the toner components. The amorphous block of the copolymer resin may be present, for example, in an amount of from about 10 to about 99 percent by weight of the toner components, in embodiments from about 40 to about 50 percent by weight of the toner components.

Toner

The copolyester resin described above may then be utilized to form toner compositions. Toner compositions of the present disclosure may also include optional colorants, waxes, and other additives. Toners may be formed utilizing any method within the purview of those skilled in the art.

The copolyester resin described above may be present in an amount of from about 65 to about 95 percent by weight, in embodiments from about 75 to about 85 percent by weight of the toner particles (that is, toner particles exclusive of external additives) on a solids basis.

Surfactants

In embodiments, colorants, waxes, and other additives utilized to form toner compositions may be in dispersions including surfactants. Moreover, toner particles may be formed by emulsion aggregation methods where the copolymer resin described above and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition, although amounts outside these ranges may be utilized.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner, although amounts outside these ranges may be utilized.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and a colorant in forming toner particles. When included, the wax may be present in an amount of, for example, from about 1 weight percent to about 25 weight percent of the toner particles, in embodiments from about 5 weight percent to about 20 weight percent of the toner particles, although amounts outside these ranges may be utilized.

Waxes that may be selected include waxes having, for example, a weight average molecular weight of from about 500 to about 20,000, in embodiments from about 1,000 to about 10,000, although weights outside these ranges may be utilized. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as camauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner particle shape and morphology.

In embodiments, toner compositions may be prepared by emulsion-aggregation processes, such as a process that includes aggregating a mixture of an optional colorant, an optional wax and any other desired or required additives, and emulsions including the copolymer resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 4 to about 5, although a pH outside this range may be utilized. Additionally, in embodiments, the mixture may be homogenized. If the mixture is homogenized, homogenization may be accomplished by mixing at about 600 to about 4,000 revolutions per minute, although speeds outside this range may be utilized. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture, although amounts outside these ranges may be utilized. This provides a sufficient amount of agent for aggregation.

In order to control aggregation and coalescence of the particles, in embodiments the aggregating agent may be metered into the mixture over time. For example, the agent may be metered into the mixture over a period of from about 5 to about 240 minutes, in embodiments from about 30 to about 200 minutes, although more or less time may be used as desired or required. The addition of the agent may also be done while the mixture is maintained under stirred conditions, in embodiments from about 50 rpm to about 1,000 rpm, in other embodiments from about 100 rpm to about 500 rpm (although speeds outside these ranges may be utilized), and at a temperature that is below the glass transition temperature of the resin as discussed above, in embodiments from about 30° C. to about 90° C., in embodiments from about 35° C. to about 70° C., although temperatures outside these ranges may be utilized.

The particles may be permitted to aggregate and/or coalesce until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation/coalescence thus may proceed by maintaining the elevated temperature, or slowly raising the temperature to, for example, from about 40° C. to about 100° C. (although temperatures outside this range may be utilized), and holding the mixture at this temperature for a time from about 0.5 hours to about 6 hours, in embodiments from about hour 1 to about 5 hours (although times outside these ranges maybe utilized), while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C. (although temperatures outside these ranges may be utilized), which may be below the glass transition temperature of the resin as discussed above.

Following aggregation to the desired particle size, the particles may then be coalesced to the desired final shape, the coalescence being achieved by, for example, heating the mixture to a temperature of from about 65° C. to about 105° C., in embodiments from about 70° C. to about 95° C. (although temperatures outside these ranges may be utilized), which may be at or above the glass transition temperature of the resin, and/or increasing the stirring, for example to from about 400 rpm to about 1,000 rpm, in embodiments from about 500 rpm to about 800 rpm, although speeds outside these ranges may be utilized. Higher or lower temperatures may be used, it being understood that the temperature is a function of the resins used for the binder. Coalescence may be accomplished over a period of from about 0.1 to about 9 hours, in embodiments from about 0.5 to about 4 hours, although times outside these ranges may be utilized.

After aggregation and/or coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Finishing

After aggregation, but prior to coalescence, once the desired final size of the toner particles is achieved, the pH of the mixture may be adjusted with a base to a value of from about 3 to about 10, and in embodiments from about 5 to about 9, although pH outside these ranges may be utilized. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

Additives

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner, although amounts outside these ranges may be utilized. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Hodogaya Chemical); combinations thereof, and the like. Such charge control agents may be applied simultaneously with the shell resin described above or after application of the shell resin.

There can also be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner, although amounts outside these ranges may be utilized. Suitable additives include those disclosed in U.S. Pat. Nos. 3,590,000, 3,800,588, and 6,214,507, the disclosures of each of which are hereby incorporated by reference in their entirety.

In embodiments, toners of the present disclosure may be utilized as low-melt polyester toners. In embodiments, the dry toner particles, exclusive of external surface additives, may have the following characteristics:

(1) Volume average diameter (also referred to as "volume average particle diameter") of from about 3 to about 25 μm, in embodiments from about 4 to about 15 μm, in other embodiments from about 5 to about 12 μm, although values outside these ranges may be obtained.

(2) Number Average Geometric Size Distribution (GSDn) and/or Volume Average Geometric Size Distribution (GSDv) of from about 1.05 to about 1.55, in embodiments from about 1.1 to about 1.4, although values outside these ranges may be obtained.

(3) Circularity of from about 0.9 to about 0.99, although values outside these ranges may be obtained (measured with, for example, a Sysmex FPIA 2100 analyzer).

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and dispersed in about 200 ml of water, filtered through a 25 micrometer screen, then put in isotonic solution to obtain a concentration of about 10%, with the sample then run in a Beckman Coulter Multisizer 3.

Toners produced in accordance with the present disclosure may possess excellent charging characteristics when exposed to extreme relative humidity (RH) conditions. The low-humidity zone (C zone) is about 10° C./15% RH, while the high humidity zone (A zone) is about 28° C./85% RH. Toners of the present disclosure may also possess a parent toner charge per mass ratio (Q/M) of from about −3 μC/g to about −35 μC/g, and a final toner charging after surface additive blending of from −5 μC/g to about −50 μC/g, although values outside these ranges may be obtained.

In accordance with the present disclosure, the charging of the toner particles may be enhanced, so less surface additives may be required, and the final toner charging may thus be higher to meet machine charging requirements.

Uses

The polymerization synthesis according to the present disclosure may be used to prepare resins for use in subsequent synthesis of emulsion aggregation toners either in the presence or absence of solvents. Copolymers possessing both crystalline and amorphous blocks may be produced. The disclosed synthesis also provides for reduced reaction times and energy costs, since a single copolymer may be utilized in the production of toners, instead of separate crystalline polyesters and amorphous polyesters.

Developers

The toner particles may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer, although amounts outside these ranges may be utilized.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %, although amounts outside these ranges may be utilized. The coating may have a coating weight of, for example, from about 0.1 to about 5% by weight of the carrier, in embodiments from about 0.5 to about 2% by weight of the carrier, although amounts outside these ranges may be utilized.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight (although amounts outside these ranges may be utilized), based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size (although sizes outside these ranges may be utilized), coated with about 0.5% to about 10% by weight, in embodiments from about 0.7% to about 5% by weight (although amounts outside these ranges may be utilized), of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations may be from about 1% to about 20% by weight of the toner composition. However, different toner and carrier percentages may be used to achieve a developer composition with desired characteristics.

Imaging

The toners can be utilized for electrophotographic or xerographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C. (although temperatures outside these ranges may be utilized), after or during melting onto the image receiving substrate.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

Synthesis of block copolymer using an anhydride in solution. A crystalline polyester/amorphous polyester block copolymer is prepared as follows. About 30 parts of a hydroxyl chain end terminated crystalline polyester resin is dissolved in about 70 parts toluene under a nitrogen atmosphere at room temperature, and an anhydride, such as succinic anhydride, (1.2 parts) is added and dissolved in the reaction mixture while stirring.

The reaction mixture is heated to approximately 100° C. with stirring under a nitrogen atmosphere until no unreacted succinic anhydride remains. A solution of about 30 parts of a hydroxyl chain end terminated amorphous polyester resin dissolved in about 70 parts toluene is then added to the reaction mixture, which is stirred and heated at 110° C. until no unreacted carboxylic acid chains are present at the ends of the succinic anhydride end of the crystalline polyester resin. After the coupling reaction is complete, the reaction mixture is filtered through alumina and then the polymer is precipitated into methanol to isolate a block co-polymer product, which is further washed with methanol.

The block co-polymer product is formed into a latex as follows. About 100 parts polymer is dissolved in approximately 700 parts ethyl acetate and the resulting solution is heated to approximately 60° C. with stirring. Separately, 6 parts DOWFAX 2A1™ surfactant solution, 2 parts sodium bicarbonate, and 550 parts deionized water are heated to approximately 60° C. with stirring. The ethyl acetate solution is then added to the aqueous solution over a period of approximately one minute, while mixing the solution with an IKA Ultra-Turrax homogenizer at a speed of 4,000 (initial) to 10,000 (final) rpm. Mixing is continued at 10,000 rpm for 30 minutes, after which the remaining ethyl acetate is removed by distillation at ambient pressure.

The resulting copolymer dispersion is then combined with a surfactant, a colorant in a dispersion, a wax in a dispersion, and subjected to emulsion aggregation conditions to form toner particles.

Example 2

Synthesis of block copolymer using a bisoxazoline in solution. A crystalline polyester/amorphous polyester block copolymer is prepared as follows. About 15 parts of a carboxylic acid chain end terminated crystalline polyester resin and about 15 parts of a carboxylic acid chain end terminated amorphous polyester resin are dissolved in about 100 parts toluene under a nitrogen atmosphere at room temperature. A bisoxazoline, such as 2,2'-(1,4-phenylene)bis(2-oxazoline) (pbox), (1.2 parts) is added and dissolved in the reaction mixture while stirring. The reaction mixture is heated to approximately 100° C. with stirring under a nitrogen atmosphere until all of the bisoxazoline is reacted to couple together the crystalline polyester resin to the amorphous polyester resin. After the coupling reaction is complete, the reaction mixture is filtered through alumina and then the polymer is precipitated into methanol to isolate a block copolymer product, which is further washed with methanol.

The block co-polymer product is formed into a latex as described in Example 1.

The resulting copolymer dispersion is then combined with a surfactant, a colorant in a dispersion, a wax in a dispersion, and subjected to emulsion aggregation conditions to form toner particles.

Example 3

Synthesis of block copolymer using an anhydride in the melt. A crystalline polyester/amorphous polyester block co-polymer is prepared as follows. About 100 parts of a hydroxyl chain end terminated crystalline polyester resin and 2 parts of succinic anhydride is heated to 170° C. to melt the polymer in a stainless steel reactor with a mechanical agitator, vacuum pump and oil bath. After a period of time the reactor is cooled and then 100 parts of a hydroxyl chain end terminated amorphous polyester resin is added and the reaction temperature is increased up to about 170° C. The reaction mixture is heated for approximately 2 hours and then discharged from the reactor followed by cooling the polymer for solidification. The block co-polymer is cooled and the material is then placed in a grinder to reduce the size of the resin pellets.

The block co-polymer product is formed into a latex as follows. About 100 parts polymer is dissolved in approximately 700 parts ethyl acetate and the resulting solution is heated to approximately 60° C. with stirring. Separately, 6 parts DOWFAX 2A1™ surfactant solution, 2 parts sodium bicarbonate, and 550 parts deionized water are heated to approximately 60° C. with stirring. The ethyl acetate solution is then added to the aqueous solution over a period of approximately one minute, while mixing the solution with an IKA Ultra-Turrax homogenizer at a speed of 4,000 (initial) to 10,000 (final) rpm. Mixing is continued at 10,000 rpm for 30 minutes, after which the remaining ethyl acetate is removed by distillation at ambient pressure.

The resulting copolymer dispersion is then combined with a surfactant, a colorant in a dispersion, a wax in a dispersion, and subjected to emulsion aggregation conditions to form toner particles.

Example 4

Synthesis of block copolymer using a bisoxazoline in the melt. A crystalline polyester/amorphous polyester block co-polymer is prepared as follows. About 100 parts of a carboxylic chain end terminated crystalline polyester resin and 2 parts of a bisoxazoline, such as 2,2'-(1,4-phenylene)bis(2-oxazoline) (pbox) is heated to about 170° C. to melt the polymer in a stainless steel reactor with a mechanical agitator, vacuum pump and oil bath. After a period of time the reactor is cooled and then 100 parts of a carboxylic chain end terminated amorphous polyester resin is added and the reaction temperature is increased up to 170° C. The reaction mixture is heated for approximately 2 hours and then discharged from the reactor followed by cooling the polymer for solidification. The block co-polymer is cooled, then the material is placed in a grinder to reduce the size of the resin pellets.

The block co-polymer product is formed into a latex as described in Example 3.

The resulting copolymer dispersion is then combined with a surfactant, a colorant in a dispersion, a wax in a dispersion, and subjected to emulsion aggregation conditions to form toner particles.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process comprising:

contacting a first polyester with a coupling agent, optionally in solution;

contacting the first polyester with a second polyester, optionally in solution;

allowing the first polyester and second polyester to react, thereby forming a block copolyester resin;

recovering the copolyester resin comprising a crystalline block and an amorphous block;

contacting the copolyester resin with at least one colorant, an optional wax, and an optional surfactant to form toner particles; and recovering the toner particles, wherein either the first polyester or the second polyester comprises the crystalline block, and the other polyester comprises the amorphous block.

2. A process as in claim 1, wherein the amorphous block is derived from at least one amorphous polyester resin of the formula:

(I)

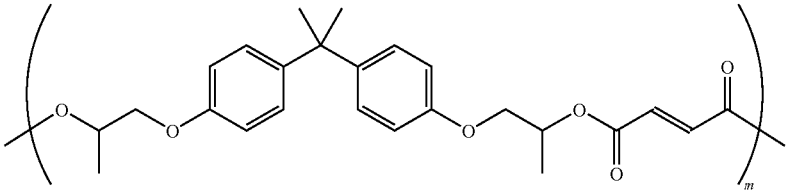

wherein m may be from about 5 to about 1000, and the crystalline block is derived from at least one crystalline polyester resin of the formula:

(II)

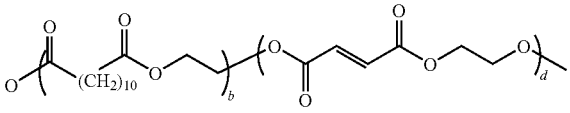

wherein b is from about 5 to about 2000 and d is from about 5 to about 2000.

3. A process as in claim 1, wherein the coupling agent comprises an anhydride selected from the group consisting of trimellitic anhydride, phthalic anhydride, glutaric anhydride, succinic anhydride and maleic anhydride.

4. A process as in claim 3, wherein the anhydride introduces a carboxylic acid group at the end of the first polyester, and the second polyester possesses at least one hydroxyl group capable of reacting with the carboxylic acid group.

5. A process as in claim 1, wherein the coupling agent comprises a bisoxazoline selected from the group consisting of 2,2'-(1,3-phenylene)bis(2-oxazoline), 2,2'-(1,4-phenylene)bis(2-oxazoline), 2,2'-(2,6-pyridylene)bis(2-oxazoline), and combinations thereof, and wherein both the first polyester and the second polyester possess carboxylic acid groups.

6. A process as in claim 1, wherein an additional polyester, which may the same or different as the first or second polyester, may be contacted with the copolyester to form additional blocks of the copolyester.

7. A process as in claim 1, wherein the crystalline block of the copolyester resin is present in an amount of from about 1 to about 90 percent by weight of the copolyester resin and possesses a melting temperature of from about 40° C. to about 120° C., and the amorphous block of the copolyester resin is present in an amount of from about 10 to about 99 percent by weight of the copolyester resin and possesses a glass transition temperature of from about 40° C. to about 70° C.

8. A process as in claim 1, further comprising contacting the copolyester resin with water to form core-shell particles, the core-shell particles comprising the crystalline block as the core and the amorphous block as the shell.

9. A process comprising:

contacting a first polyester with an anhydride, optionally in solution to form a carboxylic functional group on at least one end of the first polyester;

contacting the first polyester with a second polyester possessing a hydroxyl group on at least one end of the second polyester, optionally in solution;

allowing the first polyester and second polyester to react, thereby forming a block copolyester resin;

recovering the copolyester resin comprising a crystalline block and an amorphous block;

contacting the copolyester resin with at least one colorant, an optional wax, and an optional surfactant to form toner particles; and recovering the toner particles, wherein either the first polyester or the second polyester comprises the crystalline block, and the other polyester comprises the amorphous block.

10. A process as in claim 9, wherein the amorphous block is derived from at least one amorphous polyester resin of the formula:

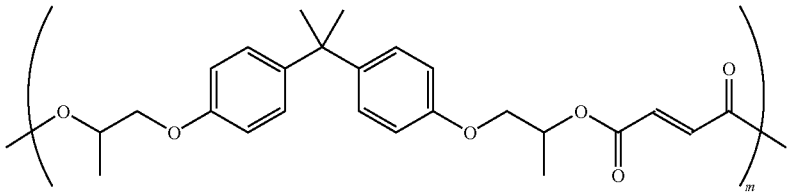

(I)

wherein m may be from about 5 to about 2000, and the crystalline block is derived from at least one crystalline polyester resin of the formula:

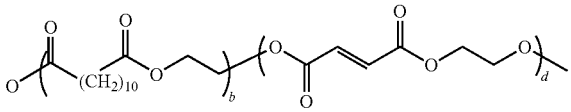

(II)

wherein b is from about 5 to about 2000 and d is from about 5 to about 2000.

11. A process as in claim 9, wherein the anhydride is selected from the group consisting of trimellitic anhydride, phthalic anhydride, glutaric anhydride, succinic anhydride and maleic anhydride.

12. A process as in claim 9, wherein an additional polyester, which may the same or different as the first or second polyester, may be contacted with the copolyester to form additional blocks of the copolyester.

13. A process as in claim 9, wherein the crystalline block of the copolyester resin is present in an amount of from about 1 to about 90 percent by weight of the copolyester resin and possesses a melting temperature of from about 40° C. to about 120° C., and the amorphous block of the copolyester resin is present in an amount of from about 10 to about 99 percent by weight of the copolyester resin and possesses a glass transition temperature of from about 40° C. to about 70° C.

14. A process as in claim 9, further comprising contacting the copolyester resin with water to form core-shell particles, the core-shell particles comprising the crystalline block as the core and the amorphous block as the shell.

15. A process comprising:

providing a first polyester possessing carboxylic acid functional groups on at least one end of the first polyester, and a second polyester possessing carboxylic acid functional groups on at least one end of the second polyester;

contacting the first polyester, optionally in solution, with the second polyester, optionally in solution, and a coupling agent comprising a bisoxazoline;

allowing the first polyester and second polyester to react, thereby forming a block copolyester resin;

recovering the copolyester resin comprising a crystalline block and an amorphous block;

contacting the copolyester resin with at least one colorant, an optional wax, and an optional surfactant to form toner particles; and recovering the toner particles, wherein either the first polyester or the second polyester comprises the crystalline block, and the other polyester comprises the amorphous block.

16. A process as in claim 15, wherein the amorphous block is derived from at least one amorphous polyester resin of the formula:

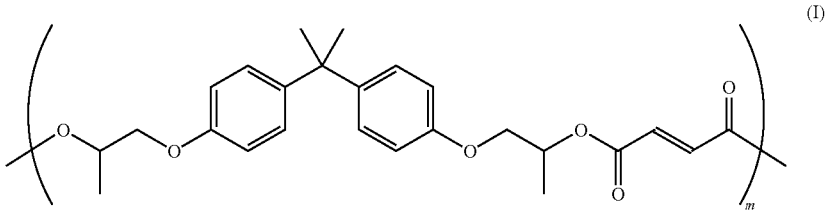

(I)

wherein m may be from about 5 to about 1000, and the crystalline block is derived from at least one crystalline polyester resin of the formula:

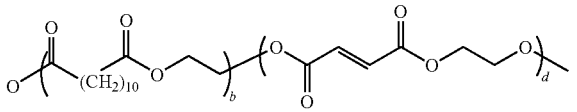

(II)

wherein b is from about 5 to about 2000 and d is from about 5 to about 2000.

17. A process as in claim 15, wherein the bisoxazoline is selected from the group consisting of 2,2'-(1,3-phenylene)bis(2-oxazoline), 2,2'-(1,4-phenylene)bis(2-oxazoline), 2,2'-(2,6-pyridylene)bis(2-oxazoline), and combinations thereof.

18. A process as in claim 15, wherein an additional polyester, which may the same or different as the first or second polyester, may be contacted with the copolyester to form additional blocks of the copolyester.

19. A process as in claim 15, wherein the crystalline block of the copolyester resin is present in an amount of from about 1 to about 90 percent by weight of the copolyester resin and possesses a melting temperature of from about 40° C. to about 120° C., and the amorphous block of the copolyester resin is present in an amount of from about 10 to about 99 percent by weight of the copolyester resin and possesses a glass transition temperature of from about 40° C. to about 70° C.

20. A process as in claim 15, further comprising contacting the copolyester resin with water to form core-shell particles, the core-shell particles comprising the crystalline block as the core and the amorphous block as the shell.

* * * * *